US005464281A

United States Patent [19]

Maro

[11] Patent Number: 5,464,281

[45] Date of Patent: Nov. 7, 1995

[54] QUICK ATTACH DOOR SYSTEM FOR A DOORLESS STORING STRUCTURE

[75] Inventor: Nicholas Maro, Chicago Heights, Ill.

[73] Assignee: Viking Metal Cabinet Co., Inc., Chicago, Ill.

[21] Appl. No.: 20,572

[22] Filed: Feb. 22, 1993

[51] Int. Cl.[6] ..... A47B 47/00; E06B 3/00

[52] U.S. Cl. ..... 312/257.1; 312/329; 49/366

[58] Field of Search ..... 312/109, 138.1, 312/326, 329, 257.1; 49/388, 366, 504

[56] References Cited

U.S. PATENT DOCUMENTS

| | | | |
|---|---|---|---|
| 1,916,189 | 7/1933 | Bales | 312/257.1 X |
| 2,371,680 | 3/1945 | Derman | 312/329 |
| 2,591,172 | 4/1952 | Ludine | 312/329 |
| 2,796,628 | 6/1957 | Van Meter | 16/230 |
| 3,166,367 | 1/1965 | Vincens | 312/329 |
| 3,186,782 | 6/1965 | Ullman | 312/329 |
| 3,499,245 | 3/1970 | Winsler et al. | 49/504 X |
| 4,836,626 | 6/1989 | Taylor | 312/257 |

FOREIGN PATENT DOCUMENTS

| | | | |
|---|---|---|---|
| 1925838 | 11/1970 | Germany | 49/366 |
| 232092 | 8/1944 | Switzerland | 312/329 |
| 482892 | 1/1970 | Switzerland | 312/257.1 |
| 592336 | 9/1947 | United Kingdom | 49/504 |
| 957812 | 5/1964 | United Kingdom | 312/257.1 |

*Primary Examiner*—Kenneth J. Dorner
*Assistant Examiner*—David E. Allred
*Attorney, Agent, or Firm*—Dvorak and Traub

[57] ABSTRACT

A quick attach door system for enclosing a doorless shelved structure, such as a cabinet, wherein the shelves are supported by a number of apertured uprights which are used to accept the installation of a pair of vertically spaced door support members, each door support member being provided with apertured upright attachment members and with a door supporting structure, the door supporting members having portions extending outwardly of the upright members, a pair of door-halves being supported by the door support members, wherein the door-halves are coupled to the door support members by hinge devices that are retractable to permit installation and removability of the door-halves. The hinge devices can be secured to prevent retractability once the door-halves are shut and locked.

13 Claims, 2 Drawing Sheets

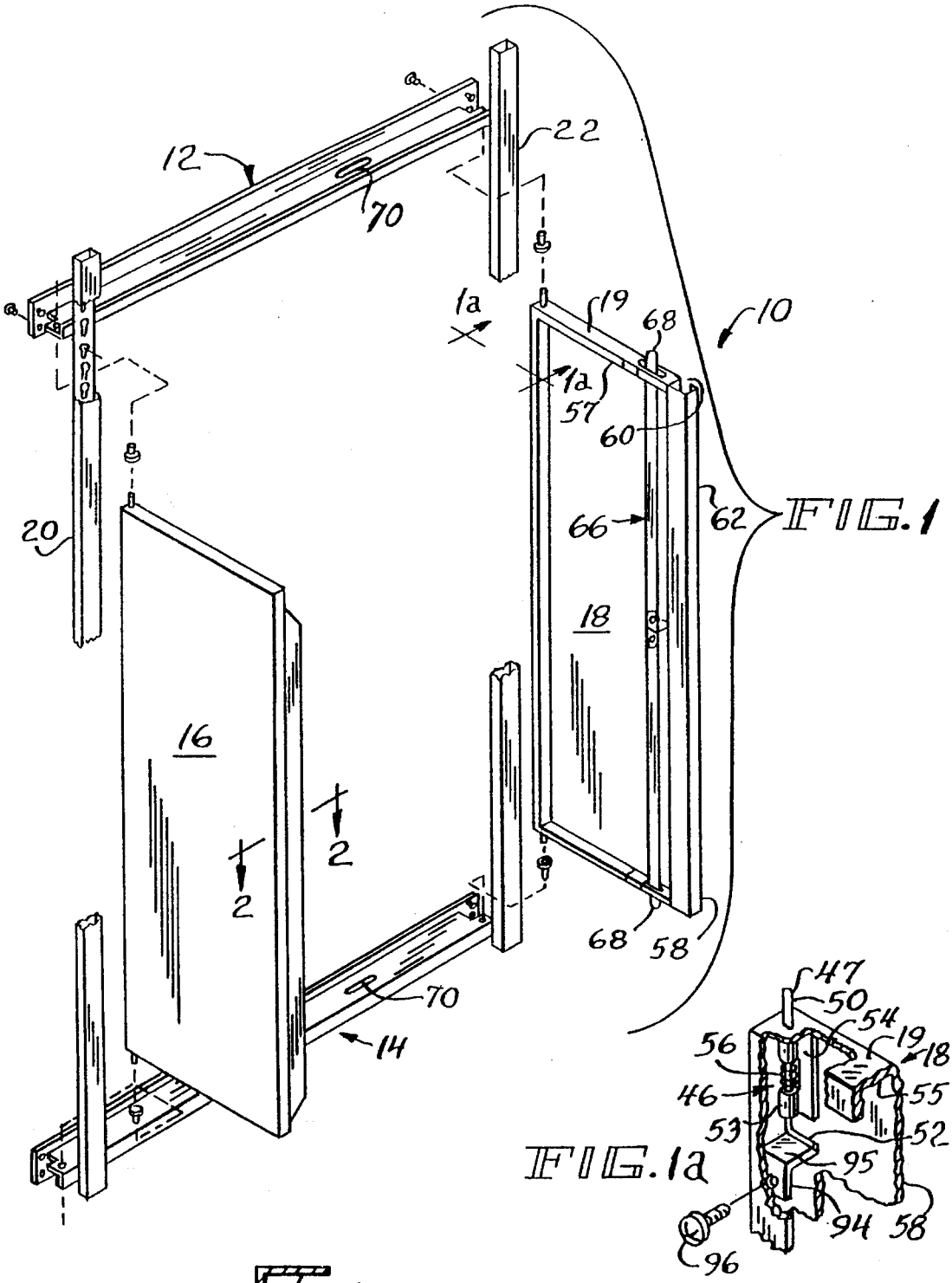
FIG. 1
FIG. 1a
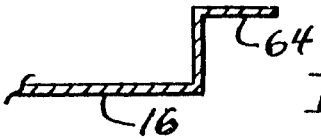
FIG. 2

QUICK ATTACH DOOR SYSTEM FOR A DOORLESS STORING STRUCTURE

This invention is primarily concerned with a door system which can be installed on a storing structure such as a cabinet or other furniture provided with shelves for storing articles, the structure or cabinet having an open face, that is, without a door. The invention is particularly concerned with a quick attach door system for installation on an open face cabinet.

PRIOR ART

Previous prior art door systems installed on open face (doorless) cabinets are provided with full perimeter frames with doors attached to the vertical uprights with butt hinges and in some cases continuous (piano) hinges. Installation generally requires drilling and fastening with bolts to support the perimeter frame on the cabinet opening. Such prior art door systems require excessive time for installation compared to the present invention. The installation is time-consuming and is a money factor leading to an extensive expense, especially on multiple installations. Manufacturing time and cost is extensively higher due to product complexities, packaging and shipping to the installation site.

FIELD OF THE INVENTION

This invention relates to a practical fast attachment of a door system to an existing storage shelving support structure, such as a cabinet having an open face. The invention can be utilized with different types of cabinets manufactured by SpaceSave, Aurora, Tennsco, and other cabinets that have similar shelf support structure within the interior of the cabinet.

The foregoing mentioned cabinets are provided with vertical apertured uprights some of which are fastened to the back of the cabinet and the other vertical uprights are attached to the front vertical sides of the cabinet opening. The apertures in the vertical uprights are adapted to receive shelving provided with lugs which are fitted into the apertures. This provision is also used in the present invention wherein an upper support member and a lower support member are provided with lugs which are fitted into the apertured uprights. Only in this case, the upper and lower support members are attachable to the front uprights adjacent the opening in the cabinet. The door used in the present invention comprises a pair of door halves, each door half being provided with a pair of retractable spring pin hinges, thus making an efficient and economical system to install.

Manufacturing, packaging and shipping to the site of installation are design benefits because the doors which are preassembled with a lock catch and retractable spring pin hinges are still individual or separate and can be compactly packed with individual upper and lower preassembled support members.

SUMMARY OF THE INVENTION

The main object of the invention is to provide a door system which can be quickly attached to a doorless structure such as an open face cabinet, provided with vertically arranged shelves.

Another object of the invention is to provide a door system having door halves which can be readily installed and dismounted if necessary.

A still further object of the invention is to provide a door system using a pair of door halves provided with quick release hinge members.

A still further object of the invention is to provide a door supported by quick release spring pin hinges which can be placed in a latched, non-removable, manner.

A door system for equipping a doorless structure provided with vertically arranged shelves supported on vertical apertured uprights, such as in a storage cabinet, wherein a pair of vertically spaced support members are provided with vertical apertured upright attachment means and with a door supporting means, the door supporting means extending outwardly of the vertical apertured upright attachment means to support a pair of door halves which are retractably hinged to the door supporting means.

Each upright attachment means have a pair of vertically extending faces provided with aperture engagement means which is provided with lugs. Alternatively, the aperture engagement means has tabs punched outwardly of the vertical faces. The faces also include holes for accepting screws adapted for fastening the upright attachment means with respect to the uprights.

A swinging edge of each door half is provided with an extended flange to engage with a corresponding extended flange on the other door half, wherein one of the door halves is provided with a lock catch for engagement with the door supporting means.

Each door half is supported by retractable hinge means in the form of a spring pin hinge positioned along a pivot swing line of the door-half, the spring pin hinge having a pin extending out of upper and lower edges of the door half, each pin being retractable into the interior of the door-half.

In particular, each support member has a structure that has an elongated vertically extending face adapted to span across and to abut the vertical uprights, each end of each face having a lug. A horizontal flange extends outwardly from the face and terminates in a vertically extending flange to define a channel with the face. Each end of the horizontal flange, adjacent its respective lug, has a cut-out adapted to accommodate the presence of an upright.

A door system for equipping a doorless shelf structure having shelf-supporting apertured uprights, the structure being an open face cabinet, the system having a pair of vertically spaced upper and lower support members, each having a vertically extending face, and at least a pair of lug members extending out of the face intended for engagement with uprights in the cabinet, the face having a horizontal flange extending in the same direction as the lug members. The horizontal flange terminates in a vertically extending flange to define a channel with the face, the horizontal flange also having at each end a pivot hole, each end of the horizontal flange having a cut-out adjacent the respective pivot hole and respective lug member. A pair of door-halves, at their pivot axes, are provided with upper and lower spring pin hinges having pivot pins engageable with said pivot holes in the upper and lower support members. At least one pin on each door-half is retractable from its door-half engaging position. One door-half has a swinging edge provided with a lapping portion to engage with an extending flange on the other door-half. One of the door-halves has a lock device with members protruding out of the door-half and engageable with the upper and lower support members. The engagement is achieved with slots in the support members receiving the protruding members from the lock device.

The upper support member on its face, adjacent each lug, is provided with a hole for receiving a screw for fastening the upper support member to the upright and to prevent accidental dislodgement.

As described hereinabove, the horizontal flanges terminate in vertically extending flanges for the purpose of rigidifying the horizontal flange along its longitudinal axis. If the gauge of the metal forming the upper and lower support members is substantially thick, it is not necessary to provide the vertically extending flange.

A door system for equipping a doorless shelved structure having shelf supporting apertured uprights, such structure being an open-face cabinet, a pair of vertically spaced upper and lower support members provided with vertically extending faces, at least a pair of lug members extending out of the faces and intended for engagement with the apertured uprights. Each of the faces has a horizontal flange extending in the same direction as the respective lug members, the horizontal flange having at each end a pivot hole and an adjoining cut-out adjacent respective pivot holes and respective lug members. The cut-outs are intended to provide clearance for the upright members. The upper and lower support members support a pair of door-halves, each door-half, at its pivot axis, being provided with upper and lower spring pin hinges which are engageable with the respective holes in the upper and lower support members.

BRIEF DESCRIPTION OF THE DRAWINGS

The invention will now be described in conjunction with the following drawings, wherein:

FIG. 1 is a perspective view of a cabinet door opening provided with a pair of vertical apertured uprights adapted for receiving a pair of door-halves;

FIG. 1*a* is a partial cross-sectional view of an upper corner of a door provided with a spring pin hinge, the cross-section being taken along the lines 1*a*–1*a;*

FIG. 2 is a partial cross-sectional view of a door shown in FIG. 1, along the lines 2—2;

DESCRIPTION OF THE PREFERRED EMBODIMENT

Figure 3:
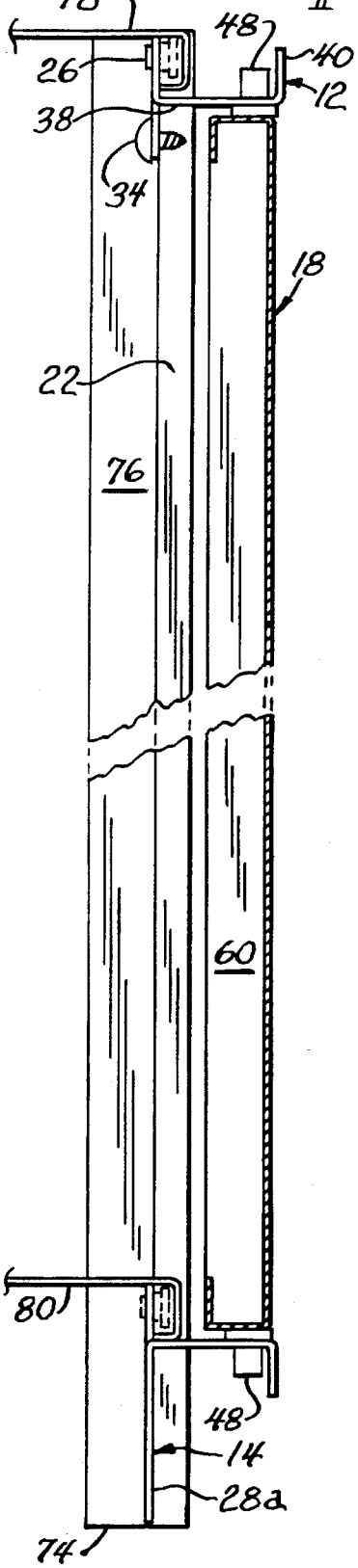
FIG. 3 is a shortened cross-sectional view along one edge of a cabinet provided with hardware for supporting a door-half on the cabinet.

As shown in FIG. 1, a quick attach door system 10 has an upper support member 12 and a lower vertically-shaped support member 14 for supporting a left door member 16 and a right door member 18, wherein the upper support member 12 is supported by left and right apertured uprights 20 and 22 and, similarly, the lower support member 14 is supported by the left and right apertured uprights 20 and 22. The door members 16 and 18 define a pair of door halves.

Figure 4:
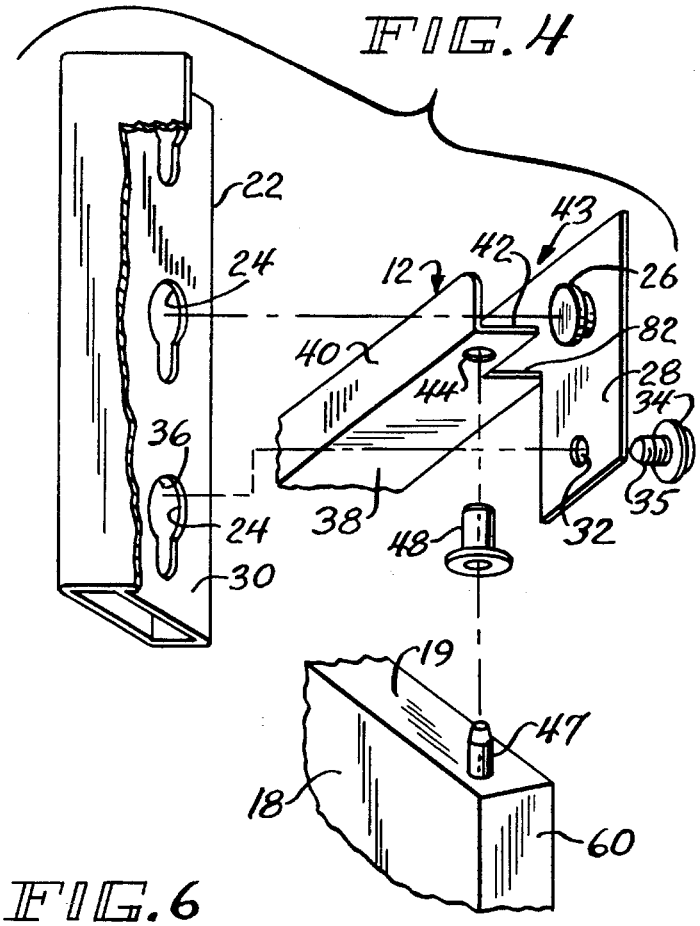
FIG. 4 is an enlarged exploded view showing the installation of an upper door support member on an apertured upright, and also showing the installation of the door-half on the upper door support member.

The attachment of the upper and the lower support members to the uprights is best illustrated in FIG. 4, wherein the upright 22 is provided with a series of apertures 24 which are adapted to receive a capped lug 26 extending from a vertical face 28 of the upper support member 12, the vertical face 28 adapted to abut a vertical face 30 of the upright 22. The vertical face 28 of the upper support member 12 has an opening 32 for receiving a screw 34 which, after the installation is completed, a threaded surface 35 of the screw 34 will engage threadedly with an inner surface 36 of the aperture 24, this engagement preventing accidental upsetting of the upper support member 12 in case the doors are jarred upwardly. The vertical face 28 and the lug 26 define upright attachment means.

Extending from the vertical face 28 of the upper support member 12 is a horizontal flange 38 which in turn terminates in a vertically bent flange 40 to define with respect to the vertical face 28 a channel 43. Adjacent each end 42 of the upper support member 12 is an opening 44 for receiving a pin 47 of a spring pin hinge 46, which pin can be provided, if desired, with a bushing spacer 48 preferably made from plastic material. The pin 47 and the spring pin hinge define a retractable hinge means.

The details of the spring pin hinge 46 can be better seen, as to its mounting, on the door 18 in FIG. 1*a*. The pin 47 has a long leg 50 provided with a finger hold 52, the leg 50 being vertically and movably supported by bushings 53 on a plate 54. The pin 47 is biased upwardly or outwardly of the door by a spring 56. To prevent unauthorized depressing of the pin 47 into the interior of the door when the doors are locked, a lock tab 94 is provided to immobilize the depression of the pin 47. The lock tab 94 has an arm 95 which abuts the finger hold 52 to thereby prevent depressing of the pin 47 internally of the door. The lock tab 94 is secured to the door 18 with a screw 96. The door 18, as shown in FIG. 1, has a hollow box construction having a panel face 58 having a flanged border 57 around the perimeter of the door, except for an edge 60, which is provided with an extended flange 62 adapted to overlap an extended flange 64 of the door 16. The door 18 is provided with a lock catch 66 having lock tabs 68 which are adapted to engage with slots 70 in the upper and lower support member 12 and 14, respectively. The structure of the lower support member 14 is comparatively similar to that of the upper support member 12, but the lower support member 14 has a longer vertical face 28*a* as shown in FIG. 3, wherein a bottom of the vertical face 28*a* will nearly touch a bottom 74 of a cabinet.

Referring to FIG. 3, there is shown the installation of the door system 10 in a cabinet 76 which, for simplicity, shows only a top shelf 78 and a bottom shelf 80.

Figure 6:
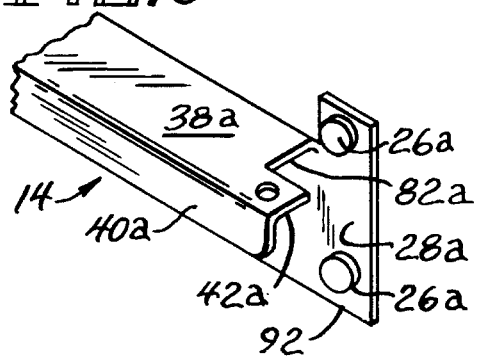
FIG. 6 is an enlarged partial view of an end of a lower door support member.

Referring to FIG. 6, there is a partial detail illustration of the lower support member 14. The member 14 has the vertically extending face 28*a* having capped lugs 26*a*. From the face 28*a*, there is a horizontally extending flange 38*a*, having a lateral edge terminating in a vertically extending flange 40*a*. The flange 38*a* has an end 42*a*. The flange 38*a* has a cut-out 82*a* adapted to abut the apertured upright 22. The installed position of the lower support member 14 can be viewed better in FIG. 3.

To install the door system into the doorless cabinet 76, the top shelf 78 and the bottom shelf 80 are removed. Then, upper support member 12 is engaged with apertured upright 22 by inserting the capped lug 26 into the aperture 24 and then securing the upper support member 12 from accidental dislocation by inserting the screw 34 to engage with a lower aperture 24 in the upright 22. Similarly, the other end of the upper support member 12 is engaged with an aperture in the other upright member 20, as best viewed in FIG. 1. A similar procedure is followed in installing the lower support member 14 with respect to the left and right uprights 20 and 22, respectively. However, there is no need for using a screw 34 to attach the lower support member to the uprights. After the upper and lower support members 12 and 14 have been secured to the uprights, the top and bottom shelves 78, 80 are replaced.

The vertical face 28 of the vertical support member 12 and the capped lug 26 comprise the upright attachment means. The vertical flange 40 and the horizontal flange 38 of the upper support member 12 comprise the door supporting means. Each end of the horizontal flange 38 is provided with a cut-out 82 to accommodate the installation of the upper support member 12 abutted against the upright 22.

Figure 5:
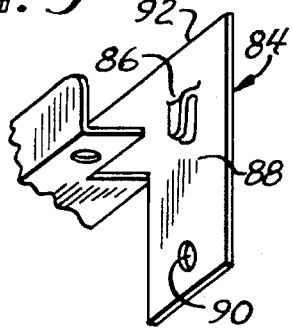
FIG. 5 is an enlarged partial view of an end of the upper door support member provided with a tab instead of a lug for engagement with the upright.

A modification of the upper support member 12 is shown in FIG. 5, wherein an upper support member 84 has a vertical face 88 provided with a tab 86 instead of a capped lug 26 for attaching the upper support member 84 to the upright. The face 88 is provided with a hole 90 for receiving a screw 34 for securing the upper support member permanently to the uprights. The lower support member can also be modified in accordance with the embodiment in FIG. 5 except that the tab 86 punched out of the face 88 would be in an opposite direction so that the tip of the tab would face toward the edge 92.

The upper support member 12 and the lower support member 14 constitute the vertically-shaped support members. The vertically extending faces 28 and **28*a* constitute the upright attachment means. The capped lug 26 and the tab 86 constitute the aperture engagement means. The left door member 16 and the right door member 18 comprise a pair of door-halves. The end 42 of the upper support member 12 and the end 42*a* of the lower support member 14 constitute the door supporting means. The spring pin hinge 46** constitutes the hinge means.

Further variations and modifications may be made without departing from the spirit and scope of the invention which is defined in the following claims.

What is claimed is:

1. A door system for equipping a doorless shelved structure having shelf-supporting apertured uprights, said structure being an open-face cabinet, said system comprising a pair of vertically spaced upper and lower support members, each having a vertically extending face, at least a pair of lug members extending out of said face towards said uprights and intended for engagement with the apertured uprights, said face having a horizontal flange extending in the same direction as the lug members, said horizontal flange terminating in a vertically extending flange to define a channel with said face, said horizontal flange having at each end a pivot hole, each end of the horizontal flange having a cut-out adjacent the respective pivot hole and respective lug member, a pair of door-halves, each door-half at its pivot axis being provided with upper and lower spring pin hinges engageable with respective pivot holes in the upper and lower support members.

2. A system according to claim 1, wherein at least one spring pin hinge on each door-half is provided with a pin which is retractable into the door-half interior.

3. A system according to claim 1, wherein each door-half has a swinging edge provided with a lapping portion to engage with an extended flange on the other door-half, and one of said door-halves has a lock device having lock members engageable with the upper and lower support members.

4. A system according to claim 3, said upper and lower support members on their respective horizontal flanges having slots to receive said lock members.

5. A system according to claim 1, wherein the upper support member on its face, adjacent each lug, is provided with a hole for receiving a lock screw.

6. A system according to claim 1, wherein each of said lug members comprises a capped stud.

7. A system according to claim 1, wherein each of said lug members comprises a tab punched out of the face.

8. A door system for equipping a doorless shelved structure having shelf supporting apertured uprights, said structure being an open-face cabinet, said system comprising a pair of vertically spaced upper and lower support members, each having a vertically extending face, at least a pair of lug members extending out of said face toward said uprights and intended for engagement with the apertured uprights, each of said faces having a horizontal flange extending in the same direction as the respective lug members, said horizontal flange having at each end a pivot hole, each end of the horizontal flange having a cut-out adjacent respective pivot holes and respective lug members, said cut-outs intended to provide clearance for the apertured uprights, a pair of door-halves, each door-half, at its pivot axis, being provided with upper and lower spring pin hinges engageable with the respective holes in the upper and lower support members.

9. A door system according to claim 8, wherein each of said horizontal flanges terminates in a vertically extending flange which defines a channel with respect to the face for rigidizing said horizontal flange along its longitudinal axis.

10. A door system according to claim 9, wherein at least one spring pin hinge on each door-half is provided with a pin which is retractable from the upper support member.

11. A door system according to claim 8, wherein one door-half has a swinging edge provided with a lapping portion to engage with an extended flange on the other door-half, and one of said door-halves has a lock device having lock members engageable with the upper and lower support members.

12. A door system according to claim 11, wherein said upper and lower support members on their respective horizontal flanges have slots to receive said lock members.

13. A door system according to claim 8, wherein the upper support member on its face, adjacent each lug, is provided with a hole for receiving a lock screw.

* * * * *